US009311912B1

(12) United States Patent
Swietlinski et al.

(10) Patent No.: US 9,311,912 B1
(45) Date of Patent: Apr. 12, 2016

(54) COST EFFICIENT DISTRIBUTED TEXT-TO-SPEECH PROCESSING

(71) Applicant: Amazon Technologies, Inc., Reno, NV (US)

(72) Inventors: Krzysztof Franciszek Swietlinski, Sopot (PL); Michal Tadeusz Kaszczuk, Gdansk (PL)

(73) Assignee: Amazon Technologies, Inc., Reno, NV (US)

( * ) Notice: Subject to any disclaimer, the term of this patent is extended or adjusted under 35 U.S.C. 154(b) by 282 days.

(21) Appl. No.: 13/947,354

(22) Filed: Jul. 22, 2013

(51) Int. Cl.
*G10L 13/00* (2006.01)
*G10L 13/04* (2013.01)
*G10L 13/02* (2013.01)

(52) U.S. Cl.
CPC ..... *G10L 13/02* (2013.01); *G10L 13/00* (2013.01); *G10L 13/04* (2013.01)

(58) Field of Classification Search
CPC ..... G10L 13/00; G10L 13/033; G10L 13/04; G10L 13/06; G10L 13/08
See application file for complete search history.

(56) References Cited

U.S. PATENT DOCUMENTS

| | | | | |
|---|---|---|---|---|
| 7,987,244 | B1 * | 7/2011 | Lewis et al. | 709/219 |
| 8,150,695 | B1 * | 4/2012 | Killalea et al. | 704/270 |
| 2002/0055843 | A1 * | 5/2002 | Sakai | 704/258 |
| 2003/0009340 | A1 * | 1/2003 | Hayashi et al. | 704/270 |
| 2003/0023442 | A1 * | 1/2003 | Akabane et al. | 704/260 |
| 2005/0131698 | A1 * | 6/2005 | Tischer | 704/270 |
| 2010/0008479 | A1 * | 1/2010 | Cho et al. | 379/88.04 |
| 2012/0069974 | A1 * | 3/2012 | Zhu et al. | 379/88.14 |
| 2014/0019137 | A1 * | 1/2014 | Kitagishi | 704/260 |

* cited by examiner

*Primary Examiner* — Samuel G Neway
(74) *Attorney, Agent, or Firm* — Seyfarth Shaw LLP; Ilan N. Barzilay; Vamsi K. Kakarla

(57) ABSTRACT

Text-to-speech (TTS) processing systems may be divided among remote TTS servers which are accessible through a network connection to local user devices. The costs for performing processing on these servers may vary according to time. To improve efficiency of TTS processing certain requests may be scheduled during low cost server times. A user may indicate a preference for such low cost delivery. A user may also indicate a preference for quick turnaround time, permitting scheduling of TTS processing during higher cost server times. A TTS processing system may also consider quality of TTS results when scheduling server processing time for a particular TTS request and may allocate more server time when higher quality results are desired.

20 Claims, 9 Drawing Sheets

TTS Delivery Options

| Time for Completion | Price | |
|---|---|---|
| As Soon As Possible | $10.00 | Select |
| Within 2 Hours | $6.00 | Select |
| Within 6 Hours | $4.00 | Select |
| Within 1 Day | $2.00 | Select |
| Within 2 Days | $1.00 | Select |

FIG. 6

COST EFFICIENT DISTRIBUTED TEXT-TO-SPEECH PROCESSING

BACKGROUND

Human-computer interactions have progressed to the point where computing devices can render spoken language output to users based on textual sources available to the devices. In such text-to-speech (TTS) systems, a device converts text into an acoustic waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

FIG. 6 illustrates a user selection display screen for TTS processing according to one aspect of the present disclosure.

DETAILED DESCRIPTION

Text-to-speech (TTS) processing may involve a distributed system where a user inputs a TTS request into a local device that then sends portions of the request to a remote device, such as a server, for further TTS processing. The remote device may then process the request and return results to the user's local device to be accessed by the user.

Various remote devices may charge differing rates for processing time based on factors such as time of processing, demand from other users, etc. If a user is cost sensitive, and a TTS request is not particularly time sensitive, the TTS request may be scheduled to be processed on a lower cost server during a time when server time is less expensive. In this manner TTS processing may be made more efficient for both a user, who can save money on the processing of his/her request, and on the processing entity, which may reserve high demand processor time for more price insensitive customers.

Figure 1:
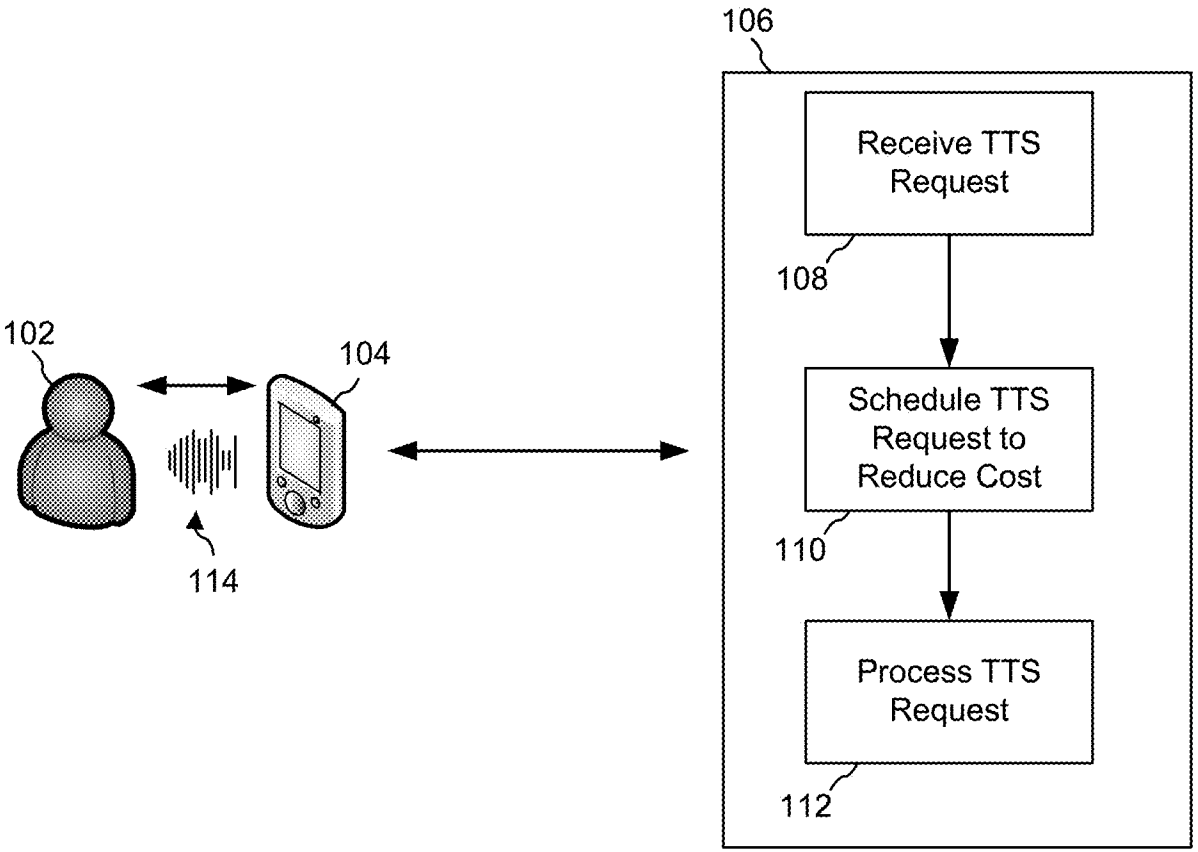
FIG. 1 illustrates cost efficient distributed text-to-speech (TTS) processing according to one aspect of the present disclosure.

FIG. 1 illustrates cost efficient distributed text-to-speech (TTS) processing according to one aspect of the present disclosure. A user 102 submits a TTS request to a local device 104. The local device 104 sends the request, along with user preferences about how the request should be processed, to a remote device 106. The remote device 106 receives the TTS request 108. The remote device 106 schedules the TTS request to reduce cost 110. The remote device 106 then processes the TTS request 112. Other factors beyond cost, such as result turnaround time and result quality may also be considered by the remote device 106 when scheduling processing of the TTS request. A more detailed explanation of a TTS system, along with further details of adjustable TTS processing devices, follows below.

Figure 2:
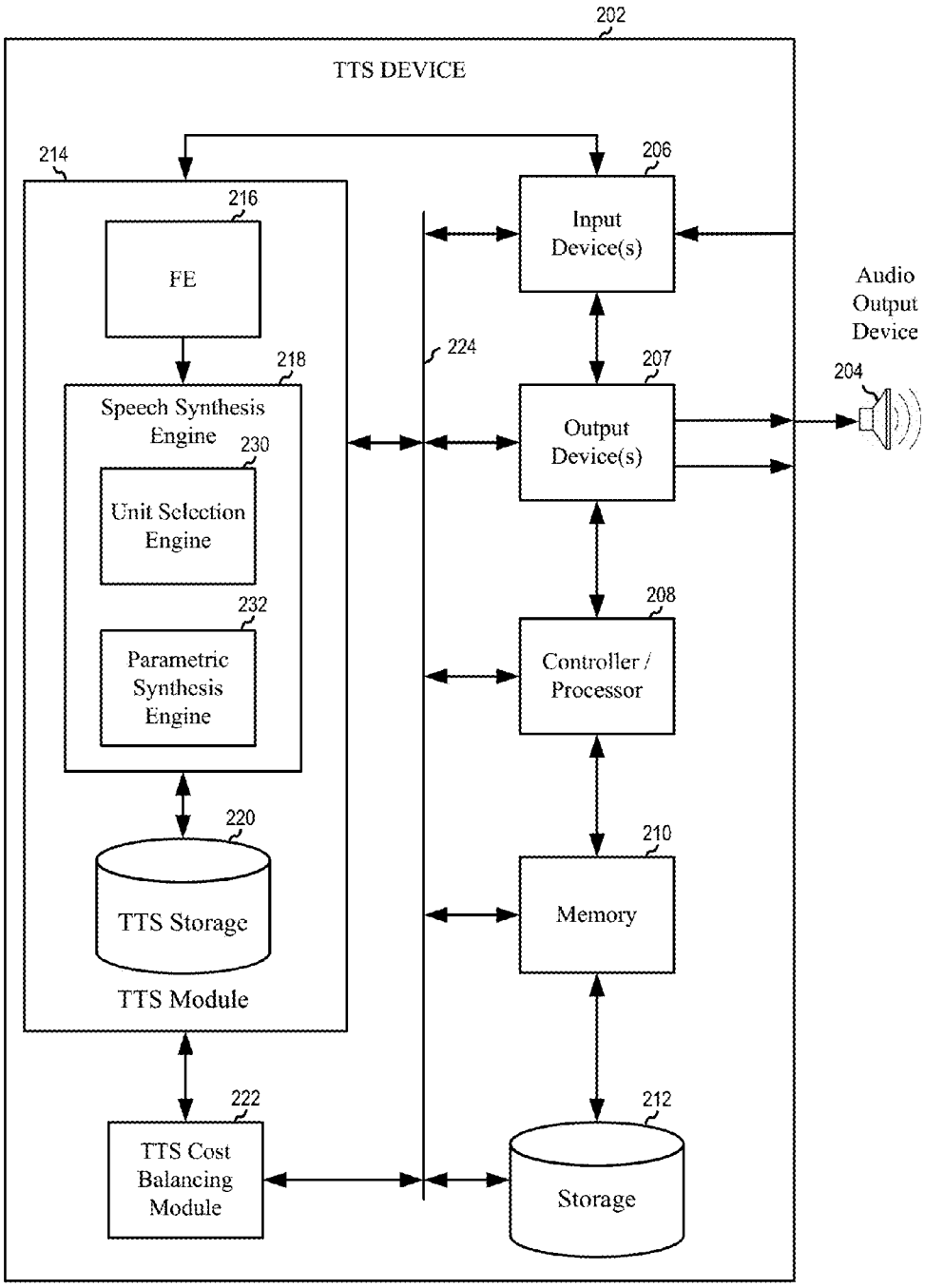
FIG. 2 is a block diagram conceptually illustrating a device for text-to-speech processing according to one aspect of the present disclosure.

FIG. 2 shows a text-to-speech (TTS) device 202 for performing speech synthesis. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input devices 206, output devices 207 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech recognition functionality such as automated teller machines (ATMs), kiosks, global position systems (GPS), home appliances (such as refrigerators, ovens, etc.), vehicles (such as cars, busses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphone, or other suitable component for emitting sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 202 may include a controller/processor 208 that may be a central processing unit (CPU) for processing data and computer-readable instructions and a memory 210 for storing data and instructions. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input device 206 or output device 207. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input device(s) 206 and output device(s) 207. A variety of input/output device(s) may be included in the device. Example input devices include an audio output device 204, such as a microphone, a touch input device, keyboard, mouse, stylus or other input device. Example output devices include a visual display, tactile display, audio speakers (pictured as a separate component), headphones, printer or other output device. The input device 206 and/or output device 207 may also include an interface for an external peripheral device connection such as universal serial bus (USB), FireWire, Thunderbolt or other connection protocol. The input device 206 and/or output device 207 may also include a network connection such as an Ethernet port, modem, etc. The input device 206 and/or output device 207 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input device 206 and/or output device 207 the TTS device 202 may connect to a network, such as the Internet or private network, which may include a distributed computing environment.

The device may also include an TTS module 214 for processing textual data into audio waveforms including speech. The TTS module 214 may be connected to the bus 224, input device(s) 206, output device(s) 207 audio output device 204, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218, and TTS storage 220. The FE 216 transforms input text data into a symbolic linguistic representation for processing by the speech synthesis engine 218. The speech synthesis engine 218 compares the annotated phonetic units models and information stored in the TTS storage 220 for converting the input text into speech. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within an external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.) into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 202 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, parts-of-speech (i.e., noun, verb, etc.), phrases, sentences, or other units. Each component of the written language units, such as graphemes, may be mapped to a component of grammatical language units, such as morphemes, which are in turn associated with spoken language units, such as the phonetic units discussed above. Each word of text may be mapped to one or more phonetic units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches a database of recorded speech against the symbolic linguistic representation created by the FE 216. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 202 with many different options for concatenating units into speech. One benefit of unit selection is that, depending on the size of the database, a natural sounding speech output may be generated. The larger the unit database, the more likely the TTS device 202 will be able to construct natural sounding speech.

In another method of synthesis called parametric synthesis parameters such as frequency, volume, noise, are varied by a parametric synthesis engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric synthesis engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric synthesis engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parameterized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGH vocoder, HNM (harmonic plus noise) based vocoders, CELP (code-excited linear prediction) vocoders, GlottHMM vocoders, HSM (harmonic/stochastic model) vocoders, or others.

Figure 3:
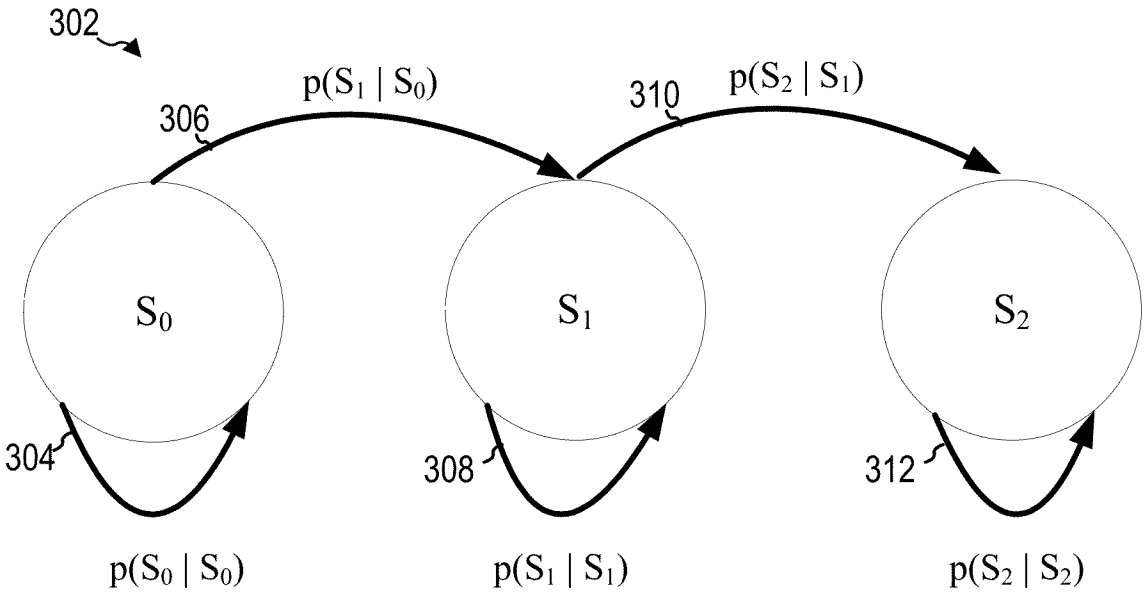
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric synthesis engine 232. The parametric synthesis engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(S_2|S_1)$ 310. As the processing continues, the parametric synthesis engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of particular states.

In addition to calculating potential states for one audio waveform as a potential match to a phonetic unit, the parametric synthesis engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 232 may lead to a number of potential audio output sequences. Based on the acoustic model and other potential models, the potential audio output sequences may be scored according to a confidence level of the parametric synthesis engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. A unit selection engine 230 first determines what speech units to use and then combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the linguistic features of a desired speech output (such as pitch, prosody, accents, stress, syllable position, word position, etc.). A join cost represents how well a speech unit matches a consecutive speech unit for purposes of concatenating the speech units together in the eventual synthesized speech. A unit's fundamental frequency (f0), spectrum, energy, and other factors, as compared to those factors of a potential neighboring unit may all effect the join cost between the units. The overall cost function is a combination of target cost, join cost, and other costs that may be determined by the unit selection engine 230. As part of unit selection, the unit selection engine 230 chooses the speech unit with the lowest overall combined cost. For example, a speech unit with a very low target cost may not necessarily be selected if its join cost is high.

A TTS device 202 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the speech unit database the better the speech synthesis may be achieved by virtue of the greater number of unit samples that may be selected to form the precise desired speech output.

Figure 4A:
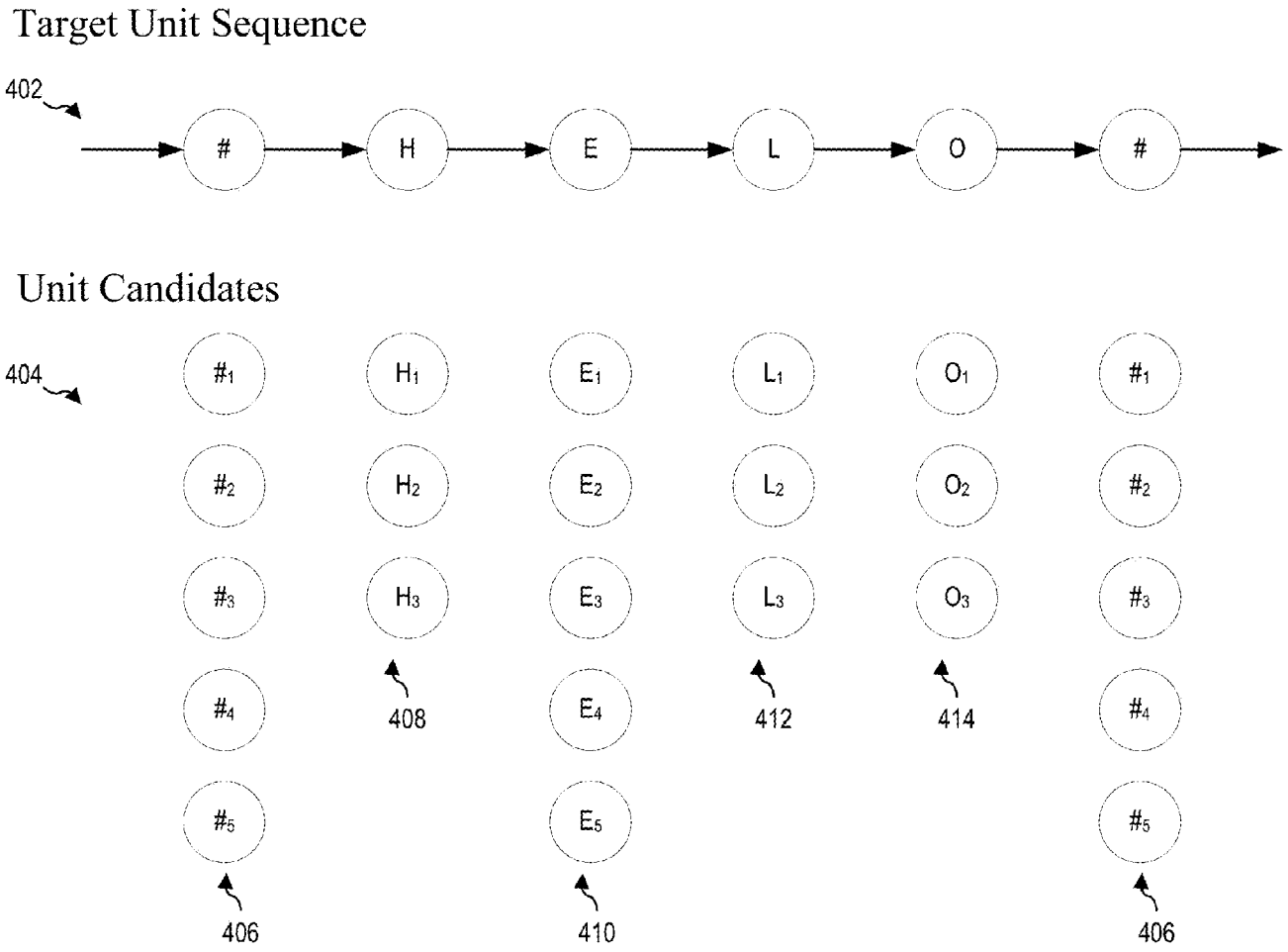
FIGS. 4A-4B illustrate speech synthesis using unit selection according to one aspect of the present disclosure.
Figure 4B:
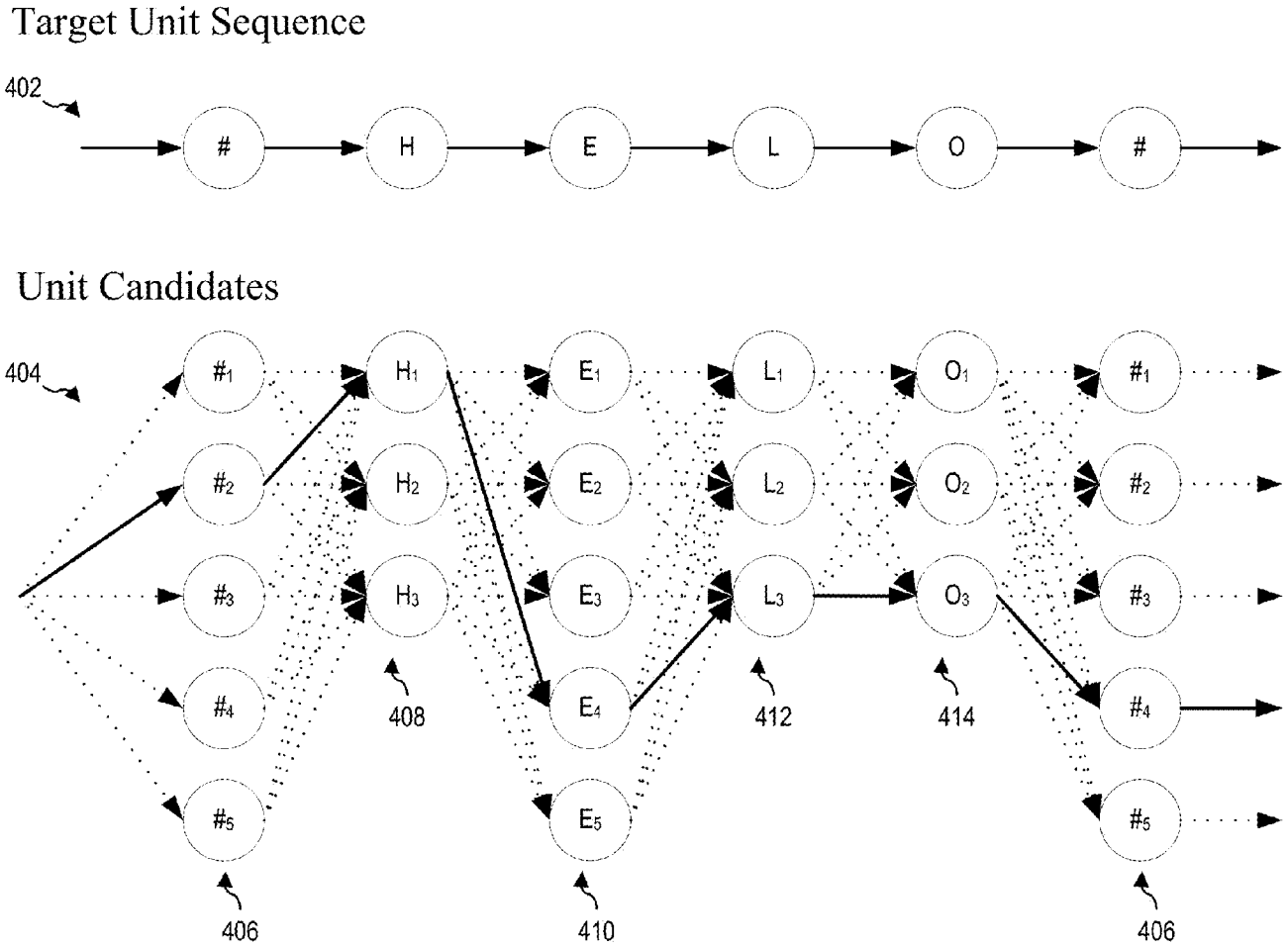

For example, as shown in FIG. 4A, a target sequence of phonetic units 402 to synthesize the word "hello" is determined by the unit selection engine 230. A number of candidate units 404 may be stored in the TTS storage 220. Although phonemes are illustrated in FIG. 4A, other phonetic units, such as diphones, may be selected and used for unit selection speech synthesis. For each phonetic unit there are a number of potential candidate units (represented by columns 406, 408, 410, 412 and 414) available. Each candidate unit represents a particular recording of the phonetic unit with a particular associated set of acoustic features. The unit selection engine 230 then creates a graph of potential sequences of candidate units to synthesize the available speech. The size of this graph may be variable based on certain device settings. An example of this graph is shown in FIG. 4B. A number of potential paths through the graph are illustrated by the different dotted lines connecting the candidate units. A Viterbi algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The unit selection engine 230 may select the sequence that has the lowest overall cost (represented by a combination of target costs and join costs) or may choose a sequence based on customized functions for target cost, join cost or other factors. The candidate units along the selected path through the graph may then be combined together to form an output audio waveform representing the speech of the input text. For example, in FIG. 4B the selected path is represented by the solid line. Thus units $\#_2$, $H_1$, $E_4$, $L_3$, $O_3$, and $\#_4$ may be selected to synthesize audio for the word "hello."

Audio waveforms including the speech output from the TTS module 214 may be sent to an audio output device 204 for playback to a user or may be sent to the output device 207 for transmission to another device, such as another TTS device 202, for further processing or output to a user. Audio waveforms including the speech may be sent in a number of different formats such as a series of feature vectors, uncompressed audio data, or compressed audio data.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 5:
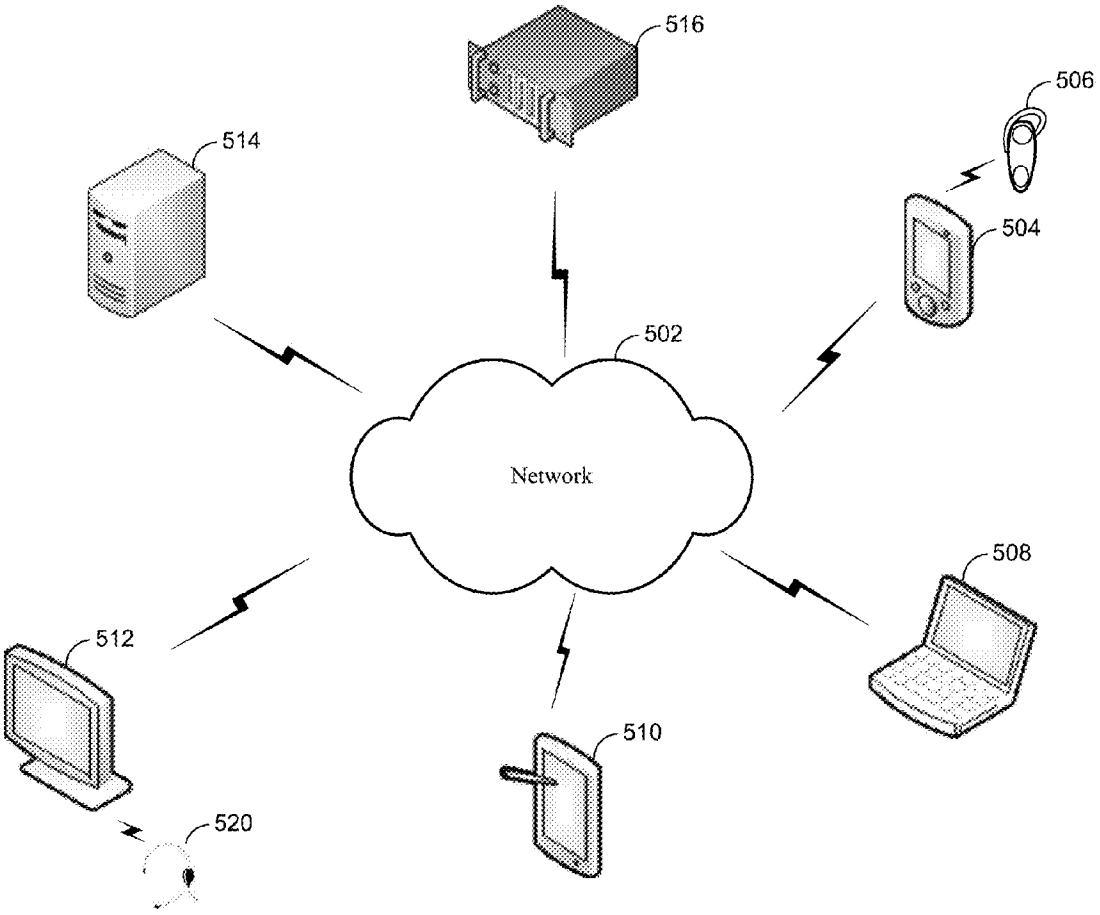
FIG. 5 illustrates a computer network for use with text-to-speech processing according to one aspect of the present disclosure.

Multiple TTS devices 202 may be connected over a network. As shown in FIG. 5 multiple devices may be connected over network 502. Network 502 may include a local or private network or may include a wide network such as the internet. Devices may be connected to the network 502 through either wired or wireless connections. For example, a wireless device 504 may be connected to the network 502 through a wireless service provider. Other devices, such as computer 512, may connect to the network 502 through a wired connection. Other devices, such as laptop 508 or tablet computer 510 may be capable of connection to the network 502 using various connection methods including through a wireless service provider, over a WiFi connection, or the like. Networked devices may output synthesized speech through a number of audio output devices including through headsets 506 or 520. Audio output devices may be connected to networked devices either through a wired or wireless connection. Networked devices may also include embedded audio output devices, such as an internal speaker in laptop 508, wireless device 504 or table computer 510.

In certain TTS system configurations, a combination of devices may be used. For example, one device may receive text, another device may process text into speech, and still another device may output the speech to a user. For example, text may be received by a wireless device 504 and sent to a computer 514 or server 516 for TTS processing. The resulting speech audio data may be returned to the wireless device 504 for output through headset 506. Or computer 512 may partially process the text before sending it over the network 502. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

In such a distributed TTS system, requests from local devices may go to one or more remote devices for processing. Many remote processing systems, however, employ a variable structure when it terms for costs for obtaining processing time for remote devices. For example, services which offer "cloud" processing at a cost may increase the costs during times of high demand, such as the end of the month for corporate customers, end of the quarter for financial customers, tax filing deadlines for various customers, during typical business hours for customers in certain geographic regions, etc. The prices for processing time may vary depending on a number of factors, but for certain processing systems there will be times when prices are higher than at other times.

TTS requests may also be of different lengths and complexity, which may determine the amount of processing time each request will take to process. User preferences may also adjust how TTS requests should be handle as certain requests may be time sensitive, others may be cost sensitive, and still others may be quality sensitive and may require additional processing resources (and potentially higher costs) to ensure quality metrics are met. Other TTS requests may be sensitive to multiple variations of these concerns and at different degrees.

To achieve satisfactory TTS processing for the lowest possible monetary cost, TTS requests may be categorized according to desired levels of performance factors, such as quality, cost and turnaround time. The TTS requests may then be allocated for processing by remote devices capable of performing TTS processing based on the above factors as well as the monetary cost of processing time for the remote device(s). A TTS cost balancing module 222, as illustrated in FIG. 2, may be configured for performing an analysis of the various factors to complete a TTS request and how each request should be allocated to one or more servers and at what time to meet the factors (such as cost, quality and turnaround time) for each individual request. The TTS cost balancing module 222 may be associated with a particular server or may be located as part of a TTS system manager, which controls and manages the assignment of TTS requests among different servers. The TTS cost balancing module 222 may schedule TTS resources among different servers, storage facilities, etc.

Server processing time may be priced according to certain distinct units, such as hours, quarter hours, etc. To make efficient use of purchased processing time, TTS requests may be grouped together to completely fill a purchased server time unit. Time for completion of TTS processing for a particular request may be based on a number of factors including input text length for the request, complexity of the request, desired quality of results (with more server time typically leading to more complex processing and higher quality results) available server time, server processing capability, etc. These, and other factors, may be considered when grouping TTS requests for sending to a TTS processing server.

TTS requests may also be divided into discrete portions for processing at different times and/or by different servers. For example, if a particular server is well situated to perform TTS pre-synthesis processing (called pre-processing below), such as phonetic transcription or prosodic annotation, those portions of multiple TTS requests may be sent to that particular server. In another example, if a long TTS request is to be completed in a particularly short time frame, pre-processing of the TTS request may be performed on one server, while synthesis of text may be assigned to a second, third, or even more servers to be processed in parallel in order to speed completion of the request. In another example, if a long TTS request is particularly cost sensitive, its pre-processing may be performed at one time and its synthesis may be performed at a second (or more times) and possibly spread out among multiple servers to take advantage of lowest available cost server time.

If TTS requests are to be divided, a TTS cost balancing module 222 or other component may divide the TTS request into logical portions for efficient distribution of portions among servers, times, etc. to meet the various performance factors. The logical portions that a TTS request may be divided into for distributed processing may depend on a variety of factors, such as the original language of the TTS request, the content of the request, etc. Thus, it may be desirable to perform a certain amount of pre-processing, such as phonetic transcription, prosody generation, prosodic annotations, or the like to determine logical break points in the text of the request (or in other processing points of the request) prior to dividing the text of a TTS request for speech synthesis. Examples of logical portions include a logical sentence (that is, the text between two punctuation marks), sentence, paragraph, section header, etc. The pre-processing may be for an entire TTS request or for a logical portion of the TTS request. The pre-processing may determine certain information to be used across multiple logical sections, such as language selection, homograph pronunciation, intonation, voice selection, contextual phonemes, etc. Results of the pre-processing may then be sent to a server along with a portion of the text of the TTS request for further processing, such as speech synthesis, which is typically more computationally intensive than the pre-processing.

If a TTS request is divided for processing, the results of processing of individual sections of a particular TTS request may be stored together in a remote storage location or may be stored in separate locations. The storage locations may be associated with the user who submitted the TTS request. A TTS device may then access the results sections, assemble them if appropriate and make them available to a user according to a user's desired delivery scheme such as streaming, storage locker access, etc. Any costs for storage of such individual sections may be considered by the TTS cost balancing module 222 when determining how to schedule processing of a TTS request.

In one aspect, a user may specify preferences for processing options for a particular TTS request. For example, the user may specify a time within which the request should be completed, a desired quality level of the TTS results and/or how much money a user is willing to spend to process the TTS request. Preferences for other processing options may also be specified. The user may also indicate certain preferences to apply to more than one TTS request. In one aspect, the user may be presented with a user interface to indicate preferences for TTS processing. In one aspect, the user may indicate a preference for certain processing options and based on those preferences be presented with a value for unselected options. For example, a user may indicate a desire to receive TTS results within one week and may be given potential pricing between $1 and $5 depending on result quality. In another example, a user may indicate a desire for the highest available quality and a budget of $5 and be given an estimated turnaround time of five days. In another aspect, the system may indicate to a user that alternative metrics may be available. Such as suggesting to a user that if he/she is willing to spend $25, the turnaround time may be reduced to one day. The system may predict such metrics based on the present load of a TTS system, the complexity of a user request, historical TTS load patterns, a number and complexity of other pending TTS requests, and other factors. In another aspect, the user may select a range for one metric (such as price) and be provided with potential ranges for one or more other metrics. The TTS system may also dynamically adjust its estimates for performance factors if operating conditions (such as a server load) for the TTS system change.

The user interface may be operated by the TTS cost balancing module 222 or other components of a TTS device or system. In another aspect, certain metrics may not be made available for user configuration. For example, it may be undesirable to allow a user to select a quality of results below a certain threshold for risk of damaging a service's reputation for high quality. As a result, a user may only be presented with selecting options for price or turnaround time.

Figure 7:
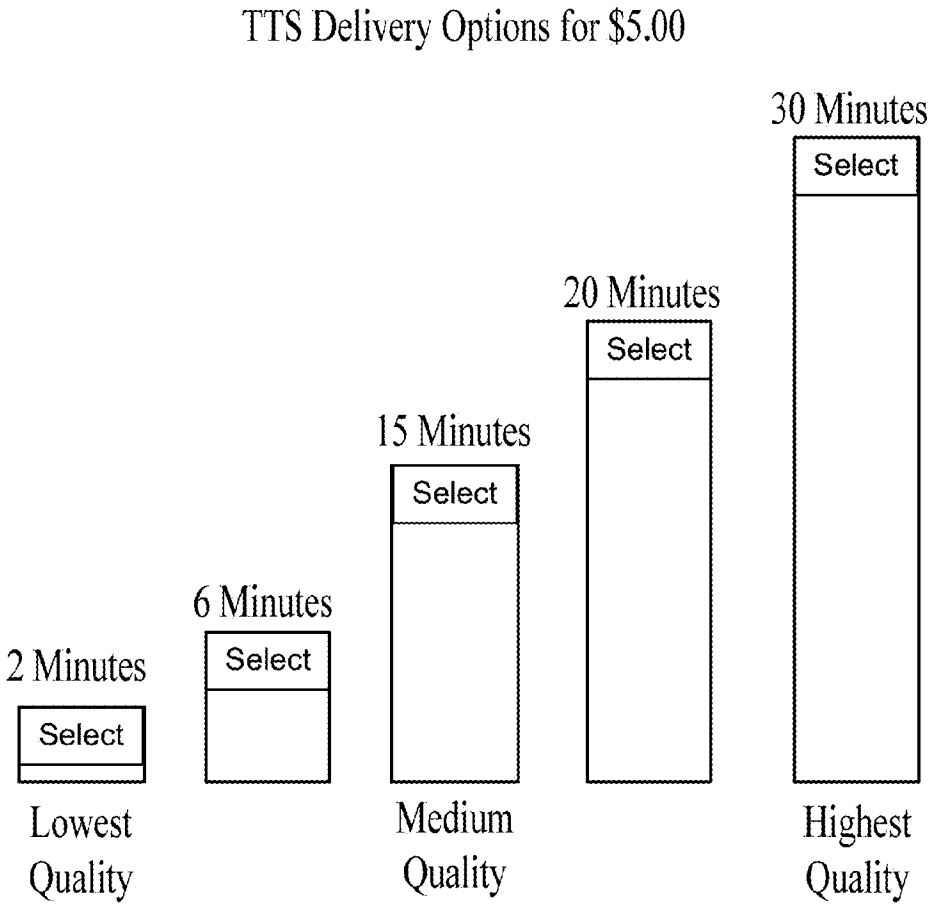
FIG. 7 illustrates a user selection display screen for TTS processing according to one aspect of the present disclosure.

FIG. 6 illustrates an example user interface for receiving a user TTS request based on user preferences. As illustrated, a user may be presented with different time/pricing schemes to complete a TTS request. The user interface shown in FIG. 6 may be displayed to a user who has already selected a quality level or for TTS processing where the quality level is already determined. As illustrated, a user may select various completion times, each associated with a different cost level. FIG. 7 illustrates another example user interface for receiving a user TTS request based on user preferences. As shown in FIG. 7 a user is presented with different quality/time options based on a given price of $5. The user may then select one of the available delivery options. A variety of other possible interfaces and user preference options are possible. For example, a user may indicate a desire for the fastest possible processing for a certain price, or may be presented with a graph represented different prices for different quality/time options. In another option a system may offer an auction-type system where multiple users may input a maximum price they are willing to pay to have TTS results provided within a certain time window and the system will accept the highest bids and process those corresponding requests. In another option, a user may specify delivery of results as soon as possible at a specified (or default) quality level where the user pays the market price for the processing.

In another aspect, the system may present a user with the option of receiving TTS results in batches, particularly for long TTS requests (such as a book). In this aspect the system may perform a cost analysis and determine that one delivery schedule with a particular cost structure may allow the user serial access to TTS results. Delivering TTS results in this manner may reduce system costs associated with storage of partial TTS result while awaiting completion of an entire request.

Figure 8:
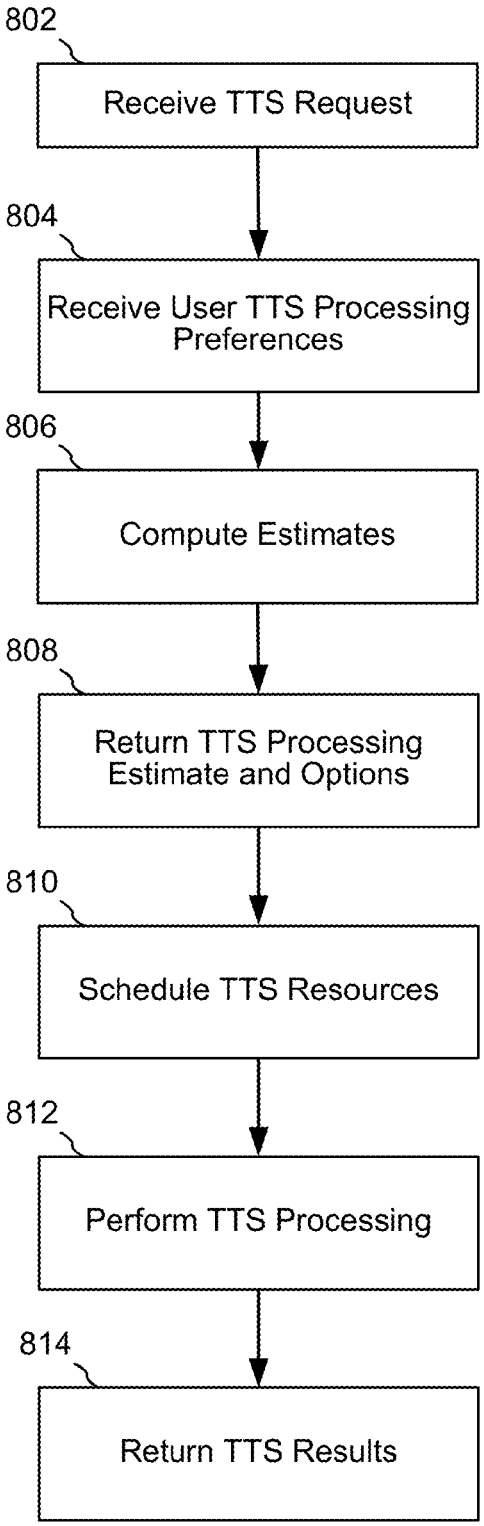
FIG. 8 illustrates cost efficient distributed TTS processing according to one aspect of the present disclosure.

FIG. 8 illustrates cost efficient distributed TTS processing according to one aspect of the present disclosure. In block 802 a TTS device receives a TTS request from a user. The TTS request may include a sequence of text to be synthesized along with other potential information regarding the substance of the text. The TTS device, or a different device, receives user TTS processing preferences from the user, as shown in block 804. The processing preferences may include user preferences regarding one or more of cost of processing, time of delivery of processing results, quality of processing results, delivery location, etc. The TTS device may then compute estimates for processing the TTS request, as shown in block 806, and return a TTS processing estimate and options to a user, as shown in block 808. Based at least in part on the received TTS request and the received TTS processing preferences, the TTS device may schedule TTS resources for performing the processing of the TTS request, as shown in block 810. The resources may include processing server time, result storage, delivery mechanism, or the like. The TTS device, or another device, may then perform TTS processing based at least in part on the scheduled resources, as shown in block 812. When TTS results are available, they are made available to a user, as shown in block 814.

Certain methods for assigning computing resources in a distributed computing environment are disclosed in U.S. patent application Ser. No. 13/867,973, filed on Apr. 22, 2013, in the names of Helfrich, et al., entitled "OPTIONS FOR COMPUTING RESOURCES", U.S. patent application Ser. No. 13/461,605, filed on May 1, 2012, in the names of Ward, et al., entitled "JOB RESOURCE PLANNER FOR CLOUD COMPUTING ENVIRONMENTS", and U.S. patent application Ser. No. 13/465,944, filed on May 1, 2012, in the names of Corley, et al., entitled "UTILIZING EXCESS RESOURCE CAPACITY FOR TRANSCODING MEDIA", the disclosures of which is hereby incorporated by reference in their entireties.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A method for performing text-to-speech (TTS) processing, comprising:

receiving, at a server, a TTS request for TTS processing of text data into speech, wherein the TTS request is sent by a local device remote from the server and includes text data originating from the local device;

receiving a user preference for TTS processing performance factors, the TTS processing performance factors including at least one of a cost of TTS processing, a quality of TTS processing or a length of time until delivery of TTS results;

determining a plurality of processing options for completion of the TTS request based at least in part on the user preference, wherein the plurality of processing options vary over at least one of cost, quality and delivery time;

providing the plurality of processing options to the local device;

receiving a user selection of a processing option from the plurality of processing options;

scheduling TTS resources for processing the TTS request based at least in part on the user selection;

synthesizing the text data into speech based at least in part on the TTS resources; and providing audio data to the local device, the audio data including the synthesized speech.

2. The method of claim 1, wherein the plurality of processing options are based upon a minimum cost to perform TTS processing within one or more delivery times of speech resulting from the TTS processing.

3. The method of claim 1, further comprising dividing the TTS request into sections for parallel processing.

4. The method of claim 1, wherein the user preference for TTS processing performance factors comprises a maximum cost for completion of the TTS request within a certain time period.

5. A system comprising:

at least one processor;

a memory device including instructions operable to be executed by the at least one processor to perform a set of actions, configuring the at least one processor:

to receive a TTS request for TTS processing of text data into speech, wherein the TTS request is sent by a local device remote from the system and includes text data originating from the local device;

to estimate delivery conditions for completion of the TTS request, wherein the delivery conditions include an estimated cost;

to receive a user preference for TTS processing based on the estimated delivery conditions;

to schedule TTS resources for processing the TTS request based on the user preference; and to synthesize the text data into speech based at least in part on the TTS resources.

6. The system of claim 5, wherein the user preference comprises at least one of cost of TTS processing, quality of TTS processing or length of time until delivery of TTS results.

7. The system of claim 5, wherein the delivery conditions are estimated based upon a minimum cost to perform TTS processing within one or more delivery times of speech resulting from the TTS processing.

8. The system of claim 5, wherein the at least one processor is further configured to divide the TTS request into sections for parallel processing.

9. The system of claim 8, wherein the sections comprise one or more of a logical sentence, sentence or paragraph.

10. The system of claim 8, wherein the at least one processor is further configured to schedule a plurality of TTS processing devices to process at least two sections at different times based at least in part on a cost for TTS processing time by a TTS processing device.

11. The system of claim 5, wherein the delivery conditions are estimated based on at least one of a cost of TTS processing, a quality of speech resulting from the TTS processing, a delivery time of speech resulting from the TTS processing, and a delivery location for speech resulting from the TTS processing.

12. The system of claim 5, wherein the user preference further comprises a maximum price for completion of the TTS request within a certain time period.

13. A non-transitory computer-readable storage medium storing processor-executable instructions for controlling a computing device, comprising:

program code to receive a TTS request for TTS processing of text data into speech, wherein the TTS request is sent by a local device remote from the computing device and includes text data originating from the local device;

program code to estimate delivery conditions for completion of the TTS request, wherein the delivery conditions include an estimated cost;

program code to receive a user preference for TTS processing based on the estimated delivery conditions;

program code to schedule TTS resources for processing the TTS request based on the user preference; and program code to synthesize the text data into speech based at least in part on the TTS resources.

14. The non-transitory computer-readable storage medium of claim 13, wherein the user preference comprises at least one of cost of TTS processing, quality of TTS processing or length of time until delivery of TTS results.

15. The non-transitory computer-readable storage medium of claim 13, wherein the delivery conditions are estimated based upon a minimum cost to perform TTS processing within one or more delivery times of speech resulting from the TTS processing.

16. The non-transitory computer-readable storage medium of claim 13, further comprising program code to divide the TTS request into sections for parallel processing.

17. The non-transitory computer-readable storage medium of claim 16, wherein the sections comprise one or more of a logical sentence, sentence or paragraph.

18. The non-transitory computer-readable storage medium of claim 16, further comprising program code to schedule a plurality of TTS processing devices to process at least two sections at different times based at least in part on a cost for TTS processing time by a TTS processing device.

19. The non-transitory computer-readable storage medium of claim 13, wherein the delivery conditions are estimated based on at least one of a cost of TTS processing, a quality resulting from the TTS processing, a delivery time of speech resulting from the TTS processing, and delivery location for speech resulting from the TTS processing.

20. The non-transitory computer-readable storage medium of claim 13, wherein the user preference further comprises a maximum price for completion of the TTS request within a certain time period.

* * * * *